US006641240B2

(12) United States Patent
Hsu et al.

(10) Patent No.: US 6,641,240 B2
(45) Date of Patent: Nov. 4, 2003

(54) APPARATUS FOR MEASURING THE AMOUNT OF INK REMAINING IN AN INK TANK

(75) Inventors: Tejung Hsu, Putz (TW); Chih-Ching Chen, Taipei (TW)

(73) Assignee: Benq Corporation, Kweishan (TW)

( * ) Notice: Subject to any disclaimer, the term of this patent is extended or adjusted under 35 U.S.C. 154(b) by 29 days.

(21) Appl. No.: 10/058,313

(22) Filed: Jan. 30, 2002

(65) Prior Publication Data

US 2002/0122083 A1 Sep. 5, 2002

(30) Foreign Application Priority Data

Feb. 2, 2001 (TW) ..... 90102297 A

(51) Int. Cl.[7] ..... B41J 2/195
(52) U.S. Cl. ..... 347/7; 73/304 C; 73/308
(58) Field of Search ..... 347/7, 86, 87; 73/299, 302, 304 C, 308, 314

(56) References Cited

U.S. PATENT DOCUMENTS 5,583,545 A * 12/1996 Pawlowski, Jr. et al. ..... 347/7
5,623,290 A * 4/1997 Iida et al. ..... 347/7

FOREIGN PATENT DOCUMENTS

| | | | |
|---|---|---|---|
| DE | 2832908 | A1 | 2/1980 |
| DE | 3810859 | A1 | 10/1989 |
| JP | 05169679 | | 7/1993 |
| JP | 05338194 | | 12/1993 |
| JP | 06099588 | A | 4/1994 |
| JP | 06143612 | A | 5/1994 |
| JP | 09029989 | A | 2/1997 |

* cited by examiner

*Primary Examiner*—Craig Hallacher
(74) *Attorney, Agent, or Firm*—Rabin & Berdo, P.C.

(57) ABSTRACT

An apparatus for measuring the amount of ink remaining in an ink tank using a sensing module and a detecting circuit is disclosed. The sensing module comprises a fixed device connected to the casing of the ink tank and a movable device connected to the bag. As the ink is ejected, the volume of the bag increases so that the movable device moves along with the bag. The detecting circuit, coupled with the sensing module, generates a corresponding detecting signal according to the variation in the relative position of the movable device and the fixed device, and the measurement of the ink amount is thus obtained.

30 Claims, 8 Drawing Sheets

APPARATUS FOR MEASURING THE AMOUNT OF INK REMAINING IN AN INK TANK

This application incorporates by reference Taiwanese application Serial No. 90102297, Filed Feb. 2, 2001.

BACKGROUND OF THE INVENTION

1. Field of the Invention

The invention relates in general to an ink detector, and in particular, to an apparatus for measuring the amount of ink remaining in an ink tank.

2. Description of the Related Art

In recent years, the personal computer has become so popular that the peripheral computer products, such as the scanner, printer, digital camera, and MP3 player, have developed very rapidly, becoming popular also. For example, within several years, the printing technique advanced from dot matrix to ink-jet to color laser. The color laser printers produce high quality printout but are relatively expensive, and therefore they still are not an affordable option for most PC buyers. Most individuals who purchase a printer for general use want the flexibility that comes with having a color printer. The ink-jet printer therefore becomes the most popular type of printer sold today, because it is relatively inexpensive and capable of generating color images. The ink-jet printer generally uses a bubble jet or a piezoelectric print head that ejects microscopic dots of ink onto the paper to create an image. The ink is contained in an ink tank and the operation of the ink tank is described below, with reference to FIGS. 1A and 1B.

In FIG. 1A, the cross-sectional view of the ink tank is illustrated. The ink tank 100 comprises a casing 110 and a bag 115. The volume between the casing 110 and the bag 115 is filed with ink. When the ink is ejected, the volume of the ink within the casing 110 decreases and the pressure within the casing 110 also decreases. Due to the reduction in pressure, the ink fails to be ejected successfully. For ejecting the ink properly, the pressure within the casing 110 must be remained essentially constant. One way to solve this problem is to make use of the bag 115 to modulate the pressure within the casing 110. In practice, the bag 115 is made of a flexible material and is communicated with atmosphere via a vent 101 in the casing 110. Thus when the volume of the ink within the casing 110 decreases, the atmosphere enters the bag 115 via the vent 101. The pressure within the casing 110 becomes, and remains at, slightly less than 1 atm, since the capacity of the ink tank 100 is small. As the volume of ink gradually decreases, the bag 115 expands to maintain a balanced pressure in the tank 100. When ink is exhausted, the bag 115 is inflated to fill the tank 100, as shown in FIG. 1B. For the bag 115 to expand properly along the inner wall of the casing 110, a guide plate 125 can be placed under the bag 115 such that the bag 115 is dragged downward smoothly.

Under the aforementioned structure of the ink tank, ejection of the ink can be performed successfully, however, the actual amount of ink inside the ink tank is not known, which can be a great inconvenience for the user. Oftentimes, the user discovers that the printer fails to print because the ink is exhausted. Therefore, a method of estimating the volume of ink remaining in the ink tank has been developed. According to this method, the amount of ink in the ink tank is estimated by calculating the cumulative ejecting times, and the more the ejecting times, the less ink in the ink tank. Thus the user can be informed of the estimated ink amount, before starting a print job.

The ink measurement is estimated by algorithm and is susceptible to erroneous estimations if the algorithm is inaccurate. Thus, an inaccurate algorithm might estimate an ink tank to be exhausted when it is not. In this case, the printer may inaccurately give a warning of ink exhaustion, prompting the user to change the ink tank before proceeding with a print job. Then the user may unknowingly discard an ink tank that is still usable. From the buyer's point of view, the ink tank can be costly, so the buyer would want to maximize the ink tank's usage, and such an error caused by the inaccurate algorithm results in wasteful use of the ink tank and wasteful use of the buyer's money.

SUMMARY OF THE INVENTION

It is therefore an object of the invention to provide an apparatus for measuring the amount of ink remaining in an ink tank by using a sensing module to accurately monitor the amount of ink.

The invention achieves the above-mentioned object by providing an apparatus for measuring the amount of ink remaining in an ink tank, wherein the apparatus comprises a sensing module and a detecting circuit. The sensing module comprises a fixed device connected to the casing of the ink tank and a movable device connected to the bag. When the ink volume decreases, the volume of the bag increases, such that the movable device moves with the bag as the volume of the bag changes. The detecting circuit is coupled with the sensing module so that the detecting circuit generates a corresponding detecting signal (detection signal), according to the variation in the relative position of the movable device and the fixed device; thereby, a measurement of the ink amount remaining in the tank can be obtained.

In addition, several fixed devices can be located on the casing. When the movable device moves as the volume of the bag changes, the movable device will be sequentially coupled with the fixed devices and generate different detection signals, and thereby, a measurement of the ink amount can be obtained.

Furthermore, the movable device connected to the bag can be coupled with an adjustable device connected to the casing. As the volume of the bag changes, the movable device adjusts the electrical property of the adjustable device. Then the detecting circuit, coupled with the adjustable device, will generate corresponding detection signals, according to the variation in the electrical property of the adjustable device; thereby, a measurement of the amount of ink remaining is obtained.

BRIEF DESCRIPTION OF THE DRAWINGS

Other objects, features, and advantages of the invention will become apparent from a detailed description of the preferred, but non-limiting, embodiments. The following description is made with reference to the accompanying drawings in which.

DESCRIPTION OF THE PREFERRED EMBODIMENTS

The present invention uses a sensing module in the ink tank to sense the change in the volume of the bag and a detecting circuit to detect the sensing result, and thereby, obtains a measurement of the ink amount in the ink tank. The sensing module comprises a fixed device and a movable device, wherein the fixed device is connected to the casing of the ink tank and the movable device is connected to the bag. As the amount of ink and the volume of the bag vary, the position of the movable device, attached to the bag, also varies. Since the relative position of the movable device and the fixed device varies with the volume of the bag, a measurement of the ink amount can therefore be obtained from the variation in said relative position. Several preferred embodiments of the invention are illustrated in the following description.

Figure 1B:
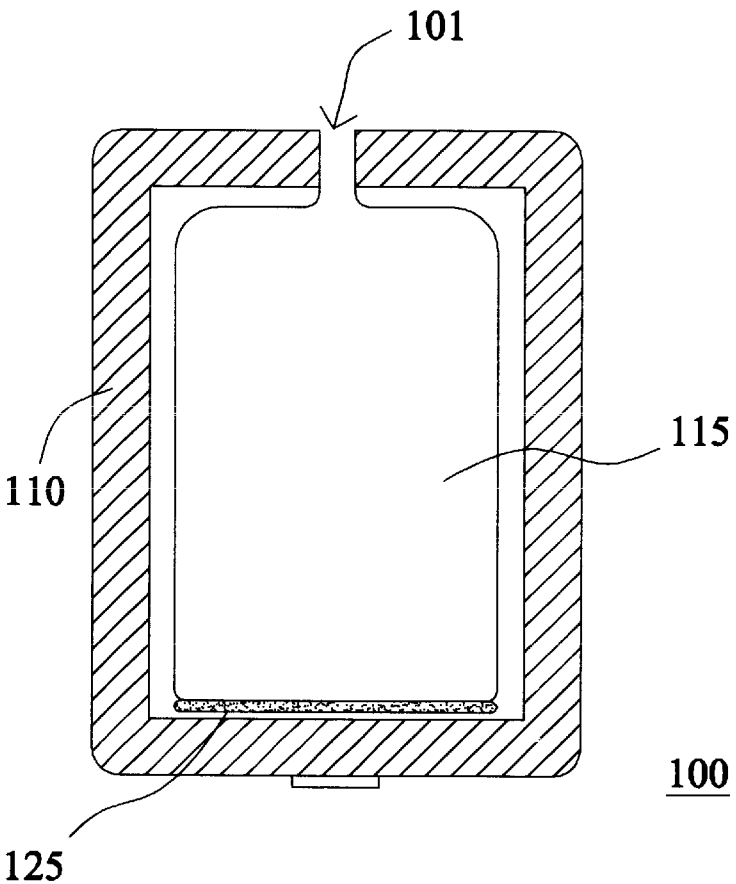
FIG. 1B (PRIOR ART)
FIG. 1B (Prior Art) is the cross-sectional view of the conventional ink tank with an inflated bag.
Figure 1A:
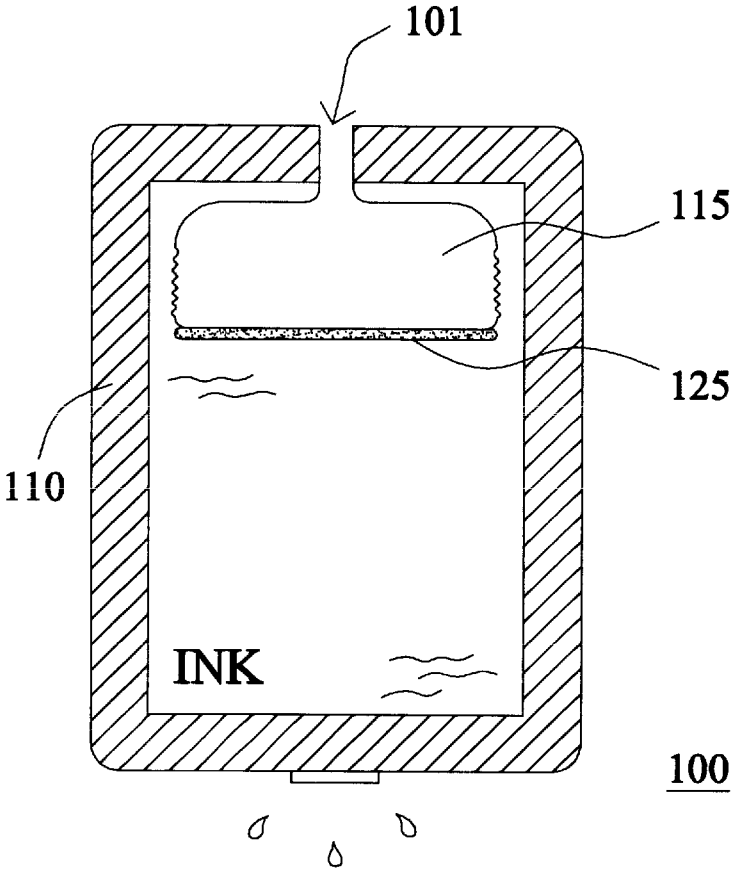
FIG. 1A (PRIOR ART)
FIG. 1A (Prior Art) illustrates the cross-sectional view of the conventional ink tank.
Figure 2B:
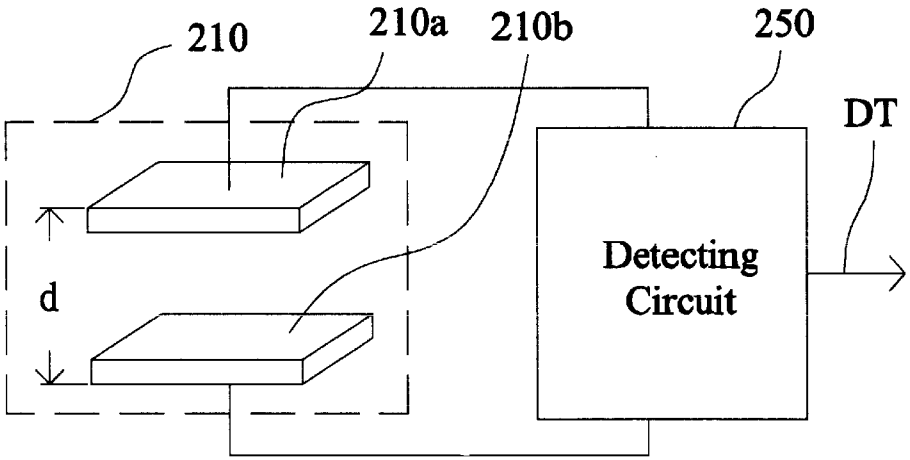
FIG. 2B shows the sensing module of FIG. 2A coupled with a detecting circuit.
Figure 2A:
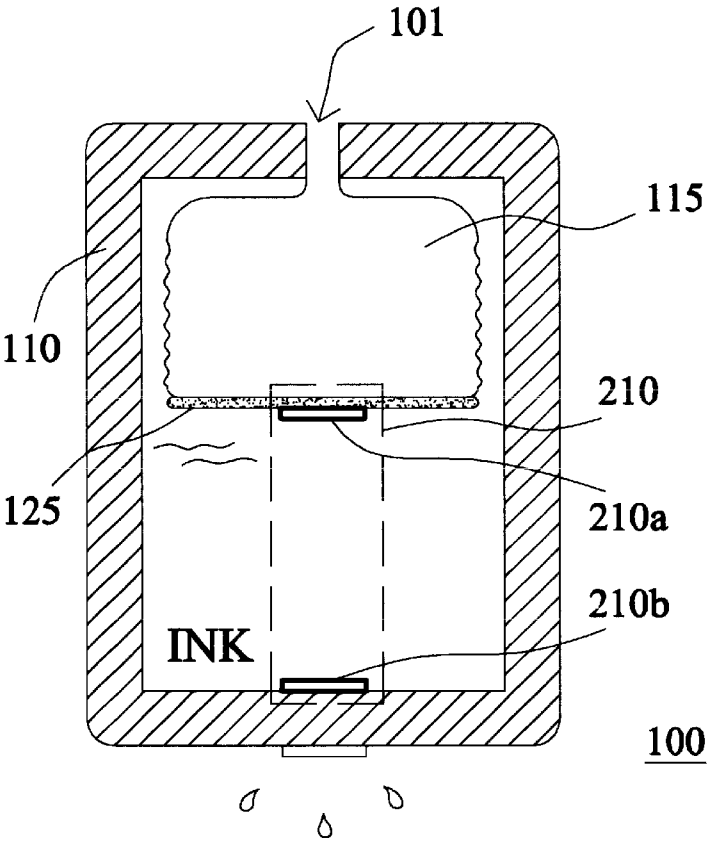
FIG. 2A shows a cross-sectional view of the apparatus for measuring the amount of ink remaining in the ink tank according to the first embodiment of the invention.

First, referring to FIG. 2A, the cross-sectional view shows an apparatus for measuring the amount of ink remaining in the ink tank 100, according to the first embodiment of the invention. The sensing module 210 comprises a movable device 210*a* and a fixed device 210*b*. The fixed device 210*b* is connected to the casing 110, for example, to the bottom of the casing 110. The movable device 210*a* is connected to the bag 115, for example, to the bottom of the bag 115. The movable device 210*a* moves with the bag 115 as the volume of the bag 115 changes. The relative position of the movable device 210*a* and the fixed device 210*b* varies as the volume of the bag 115 varies, from which the ink amount can be obtained. Next, FIG. 2B shows the sensing module 210 of FIG. 2A coupled with the detecting circuit 250. As the bag 115 inflates, the movable device 210*a* moves downward so that the distance d between the movable device 210*a* and the fixed device 210*b* decreases. In practice, the movable device 210*a* and the fixed device 210*b* can be made of conductive plates. Then, the movable device 210*a* and the fixed device 210*b* can be viewed as two electrode plates of a capacitor while the ink can be viewed as the dielectric between the two electrode plates. Since the total area of the movable device 210*a* and the fixed device 210*b* and the dielectric coefficient of ink are constant, the capacitance increases as the distance d decreases. In other words, the capacitance increases as the volume of ink decreases. The detecting circuit 250 is responsive to an electrical signal from the capacitor indicative of the variations in capacitance and generates the detection signal DT by detecting the variation in the capacitance. Therefore, the ink amount can be obtained accurately from the magnitude of the signal DT. Essentially, the movable device 210*a* and the fixed device 210*b* are electrodes and the detecting circuit 250 detects the variation in the resistance value between the movable device 210*a* and the fixed device 210*b*. Since the resistance value decreases as the distance d decreases, the detecting circuit 250 generates the detection signal DT by detecting the variation in the resistance value, and then a measurement of the ink amount can be accurately obtained.

Furthermore, the sensing module 210 of FIG. 2A can be a transceiving module having a transmitting unit and a receiving unit. The detection signal is transmitted by the transmitting unit and then received by the receiving unit. When the relative position of the transmitting unit and the receiving unit changes, the transmission distance of the detection signal, or the signal magnitude, will also change. The ink amount can be then determined from the detection signal. Various kinds of transceiving modules having this function capability include an infrared transceiver, high-frequency transceiver, and optical transceiver, for example. In addition, the transceiving module can be used as a sensing module, as explained in the following description, with reference to FIGS. 3A and 3B.

Figures 3A, 3B, 3C, 3D:
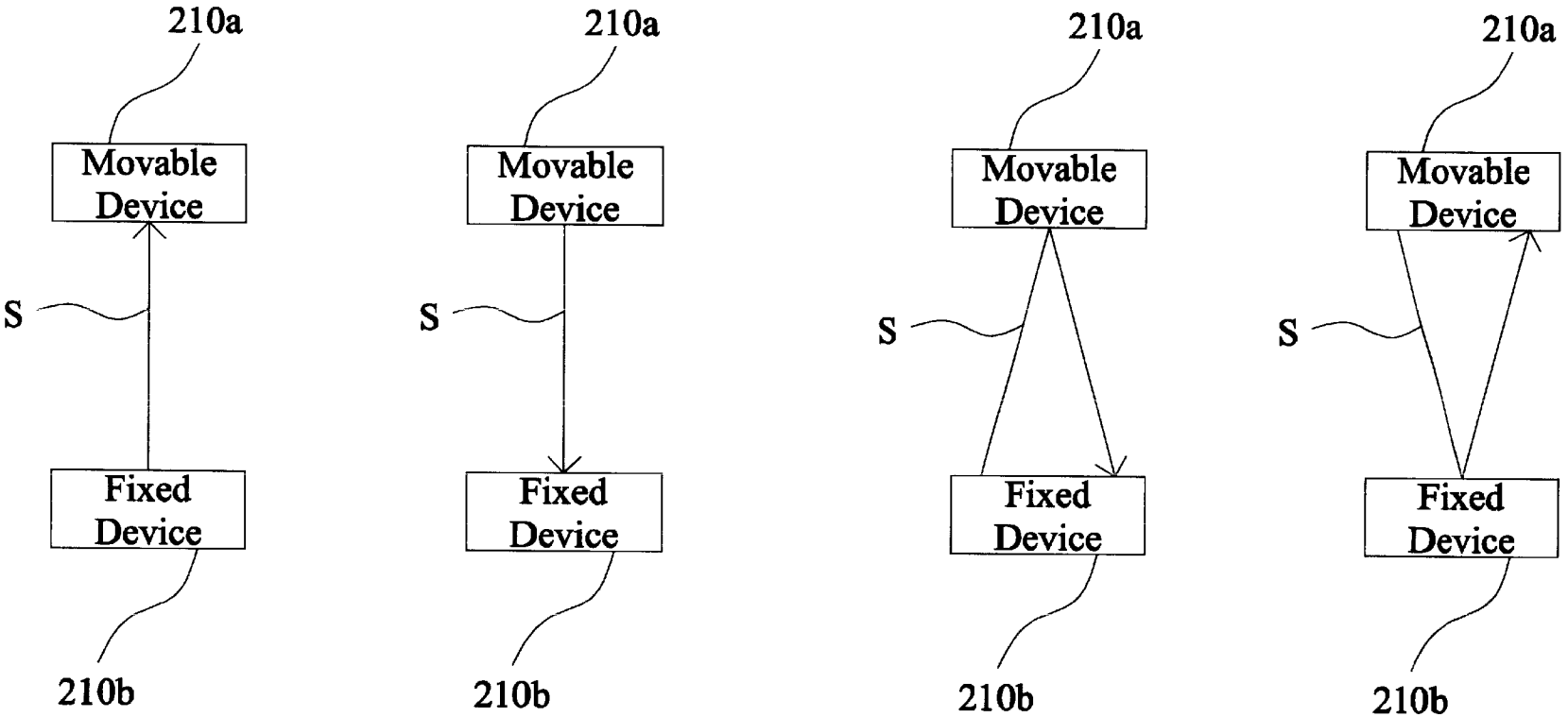
FIG. 3A shows a disposition of the transmitting unit and the receiving unit in the sensing module of FIG. 2A.
FIG. 3B shows another disposition of the transmitting unit and the receiving unit in the sensing module of FIG. 2A.
FIG. 3C shows a disposition of the reflective transceiver, which is taken as the sensing module of FIG. 2A.
FIG. 3D shows another disposition of the reflective transceiver, which is taken as the sensing module of FIG. 2A.

FIGS. 3A and 3B illustrate the dispositions of the transmitting unit and the receiving unit in the sensing module of FIG. 2A. As shown in FIG. 3A, the transmitting unit is the fixed device 210*b* of FIG. 2A, located on the bottom of the casing 110, while the receiving unit is the movable device 210*a* of FIG. 2B, located on the bottom of the bag 115. The detection signal S is transmitted by the fixed device 210*b* and then received by the movable device 210*a*. Thereby a measurement of the amount of ink remaining in the ink tank 100 can be then obtained. Similarly, as shown in FIG. 3B, the receiving unit can be the fixed device 210*b* located on the bottom of the casing 110, while the transmitting unit can be the movable device 210*a* located on the bottom of the bag 115. The detection signal S is transmitted by the movable device 210*a* and then received by the fixed device 210*b*, and thus the amount of ink can be determined using the detection signal S.

Furthermore, the optical transceiver can be a transmissive transceiver or a reflective transceiver. The transmissive transceiver requires a transmitting unit and a receiving unit, as shown in FIGS. 3A and 3B. However, the reflective transceiver differs from the transmissive transceiver, requiring a transceiving unit and a reflective unit. FIGS. 3C and 3D show the dispositions of the reflective transceiver, which is taken as the sensing module of FIG. 2A. Referring to FIG. 3C, the transceiving unit is the fixed device 210*b* of FIG. 2A, located on the bottom of the casing 110, while the reflective unit is the movable device 210*a* of FIG. 2A, located on the bottom of the bag 115. The detection signal S is transmitted by the fixed device 210*b*, reflected by the movable device 210*a*, and then received by the same fixed device 210*a*. The measurement of the ink amount is obtained from the variation in the signal magnitude corresponding to the transmission distance of the detection signal S. Similarly as shown in FIG. 3D, the reflective unit can be the fixed device 210*b* located on the bottom of the casing 110, while the transceiving unit can be the movable device 210*a* located on the bottom of the bag 115. The detection signal S is transmitted by the movable device 210*a*, reflected by the fixed device 210*b*, and then received by the same movable device 210*a*, and the ink amount can be determined using the detection signal S.

In addition, the sensing module 210 can be a simple sensing component, such as a normally open sensing component or a normally closed sensing component. The normally open sensing component can further be a normally open switch while the normally closed sensing component can further be a normally closed switch. In practice, the normally open switch or normally closed switch can be used as the fixed device 210*b*. In the case when the ink is exhausted, the movable device 210*a* gradually moves down and touches the fixed device 210*b*, and the switch status of the fixed device 210*b* will be changed accordingly. For instance, the normally open switch will be closed or the normally closed switch will be opened then. Subsequently, the detecting circuit 250 of FIG. 2B generates a corresponding detection signal DT to inform that ink is exhausted. Similarly, the normally open switch or normally closed switch can be used as the movable device 210*a*. When the fixed device 210*b* touches the movable device 210*a*, the switch status of the movable device 210*a* will be changed and a corresponding detection signal DT will be generated. According to the design, the detection signal DT is generated to warn the user that the ink is exhausted.

Figure 4B:
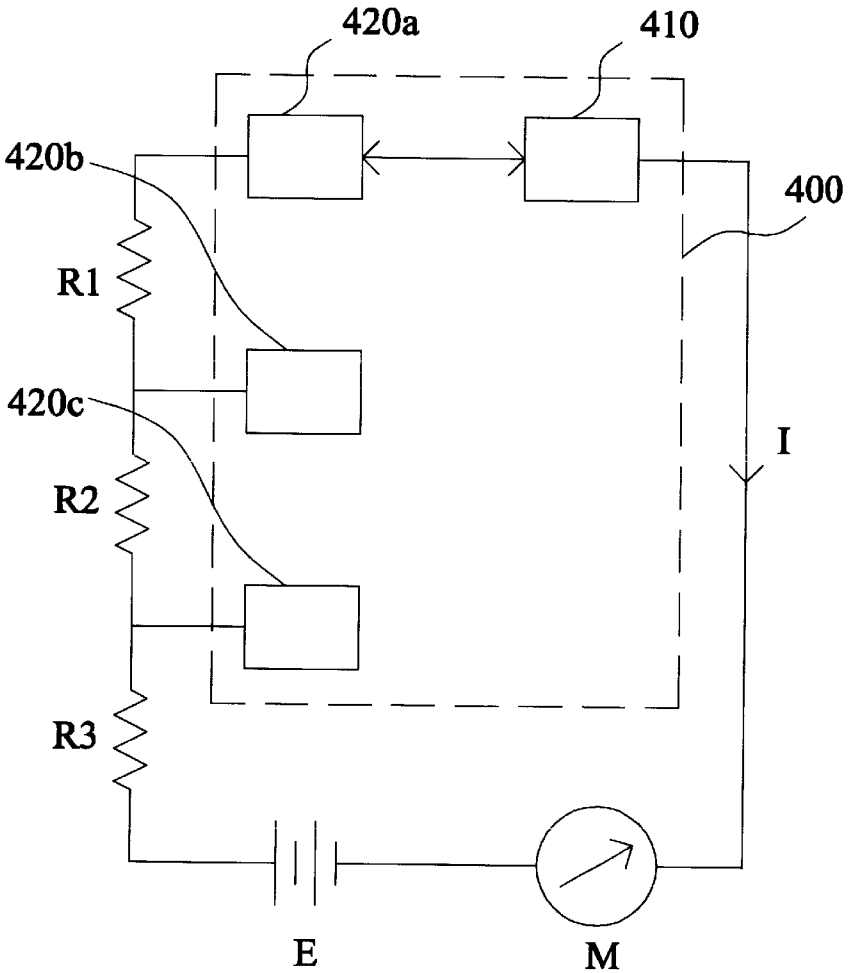
FIG. 4B shows the sensing module of FIG. 4A coupled with a detecting circuit.
Figure 4A:
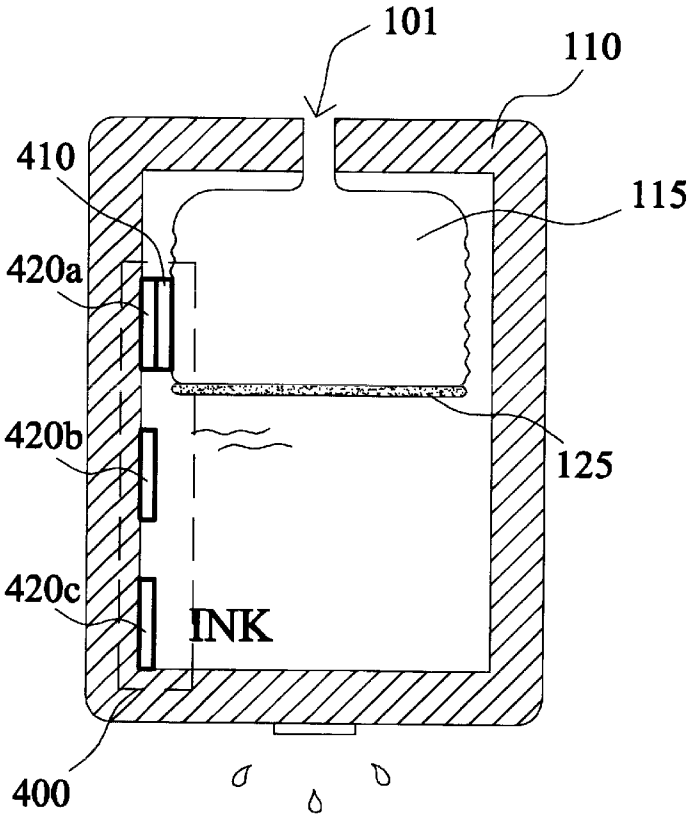
FIG. 4A shows a cross-sectional view of the apparatus for measuring the amount of ink remaining in the ink tank according to the second embodiment of the invention.

Next, FIG. 4A shows a cross-sectional view of an apparatus for measuring the ink amount remaining in the ink tank according to the second embodiment of the invention. The sensing module 400 comprises several fixed devices and a movable device 410. For instance, there are three fixed devices 420*a*, 420*b*, and 420*c* connected to one side of the casing 110, as shown in FIG. 4A. The movable device 410, connected to one side of the bag 115, moves as the volume of the bag 115 changes, and is sequentially coupled with the fixed devices 420*a*, 420*b*, and 420*c*. When the movable device 410 is connected to a different fixed device, the detecting circuit generates a different detection signal. Therefore, the measurement of the ink amount can be obtained according to the different detection signals. Referring next to FIG. 4B, the sensing module 400 of FIG. 4A is coupled with a detecting circuit. The detecting circuit comprises resistances R1, R2, and R3, power source E, and measuring tool M. When the bag 115 inflates, the movable device 410 moves downward so that the movable device 410 is sequentially coupled with the fixed device 420*a*, 420*b*, and 420*c*, as shown in FIG. 4A. When the movable device 410 is coupled with the fixed device 420*a*, the measuring tool M measures the current I as Ia; when the movable device 410 is coupled with the fixed device 420*b*, the measuring tool M measures the current I as Ib; when the movable device 410 is coupled with the fixed device 420*c*, the measuring tool M measures the current I as Ic. Since Ia Ib Ic, the measurement of the ink amount is obtained according to the variation in current through the signal transformation. In other words, the current signal is the detection signal from which the amount of ink remaining in the tank is determined.

Figure 4C:
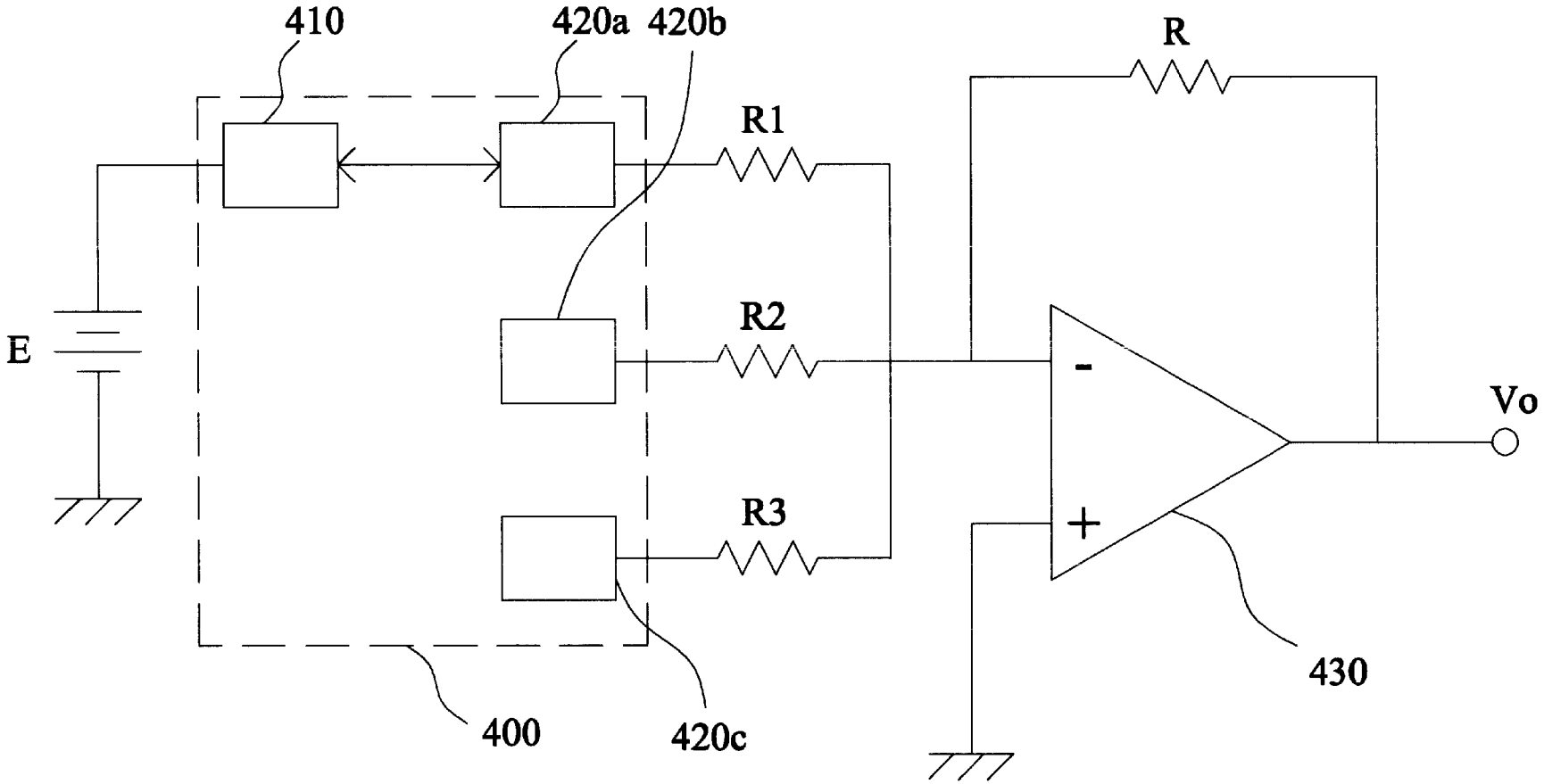
FIG. 4C shows the sensing module of FIG. 4A coupled with another detecting circuit.

Referring to FIG. 4C, the sensing module of FIG. 4A is coupled with another detecting circuit. The circuit coupled with the sensing module 400 is the detecting circuit. The detecting circuit comprises a power source E, resistances R1, R2, R3, R, and amplifier 430. When the bag 115 inflates, the movable device 410 moves downward so that the movable device 410 is sequentially coupled with the fixed device 420*a*, 420*b*, and 420*c*, as shown in FIG. 4A. When the movable device 410 is coupled with the fixed device 420*a*, the output voltage Vo of the amplifier 430 is Va; when the movable device 410 is coupled with the fixed device 420*b*, the output voltage Vo of the amplifier 430 is Vb; when the movable device 410 is coupled with the fixed device 420*c*, the output voltage Vo of the amplifier 430 is Vc. The resistance values of resistances R1, R2, and R3 are different, so that Va Vb Vc. After a signal transformation, the measurement of the ink amount is obtained, according to the variation in the output voltage Vo. In other words, the voltage signal is the detection signal from which the ink amount is determined.

Figure 5B:
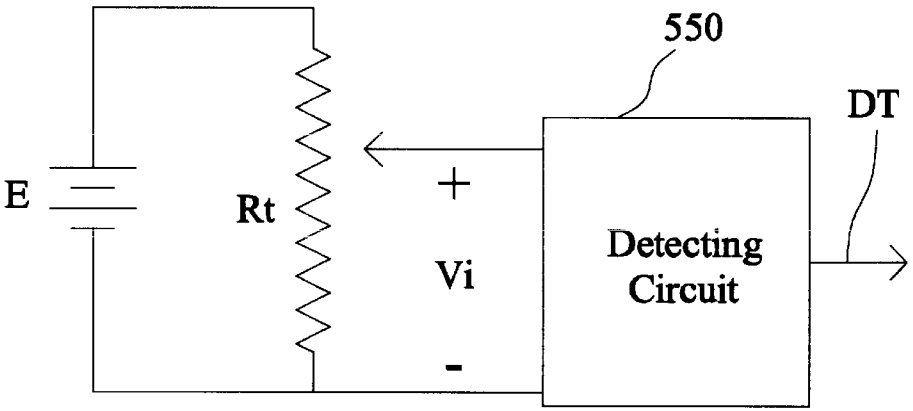
FIG. 5B shows the sensing module of FIG. 5A coupled with a detecting circuit.
Figure 5A:
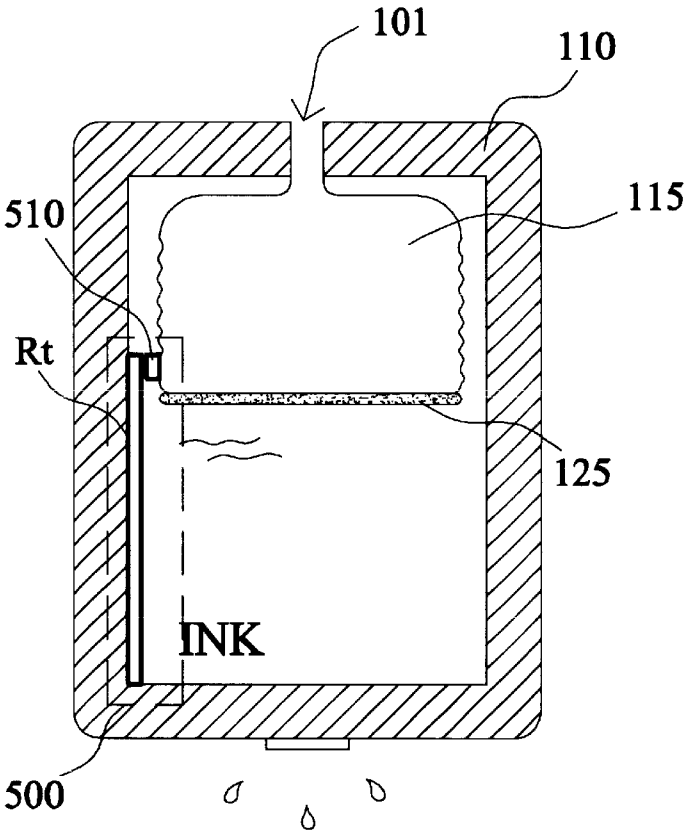
FIG. 5A shows a cross-sectional view of the apparatus for measuring the amount of ink remaining in the ink tank according to the third embodiment of the invention.
Figure 5C:
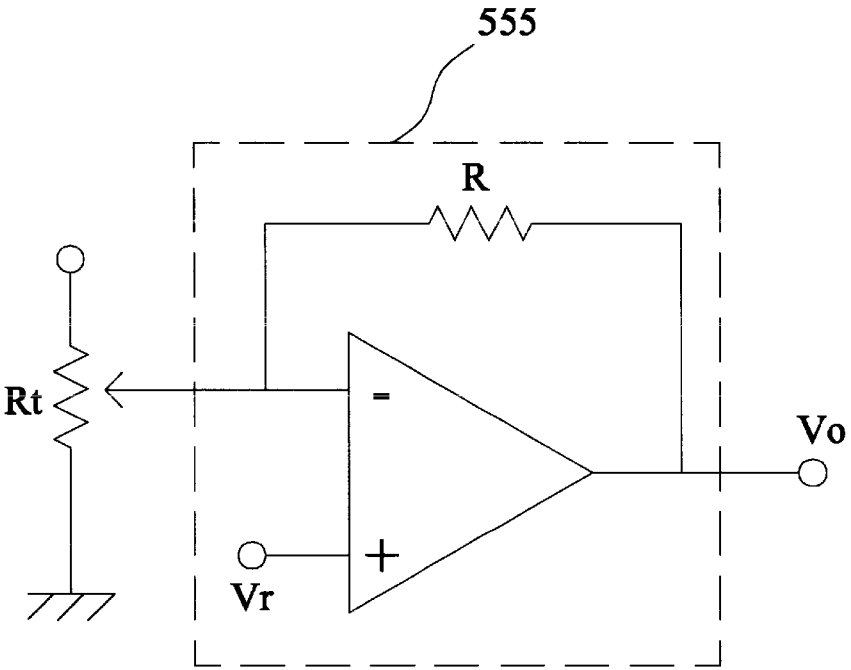
FIG. 5C shows the sensing module of FIG. 5A coupled with another detecting circuit.

FIG. 5A shows a cross-sectional view of an apparatus for measuring the amount of ink remaining in the ink tank according to the third embodiment of the invention. The sensing module 500 comprises a movable device 510 and an adjustable device Rt. The movable device 510, connected to one side of the bag 115, moves as the volume of the bag 115 changes. The adjustable device Rt is connected to the one side of the casing 110 and coupled with the movable device 510. When the bag 115 moves downward, the electrical property of the adjustable device Rt is adjusted by the interaction between the movable device 510 and the adjustable device Rt. When the electrical property changes, the detecting circuit will generate different detection signals, and thereby, a measurement of the ink amount can be obtained. Referring next to FIG. 5B, the sensing module of FIG. 5A is coupled with a detecting circuit 550. In FIG. 5B, the adjustable device Rt is a slide-wire resistance coupled with the detecting circuit 550. As the movable device 510 moves downward, the resistance value of the slide-wire resistance gradually decreases and the voltage Vi gradually decreases as well. The detecting circuit 550 generates the detection signals DT corresponding to the variation in the voltage Vi, and a measurement of the ink amount can be obtained accordingly. Referring to FIG. 5C, the sensing module 500 of FIG. 5A is coupled with another detecting circuit. The detecting circuit 555 comprises a noninverting amplifier, and the slide-wire resistance is the adjustable device Rt coupled with the detecting circuit 555. According to basic circuit principle, if the output of the noninverting amplifier is coupled with the reference voltage Vr, the output voltage Vo is Vr(1R/Rt). When the movable device 510 moves downward, the resistance value of the slide-wire resistance gradually decreases and the voltage Vo gradually increases. The detecting circuit 555 generates a different voltage Vo corresponding to the change in the property of the adjustable device Rt. Therefore, the voltage Vo is the detection signal, and a measurement of the ink amount can be obtained accordingly.

Figure 6:
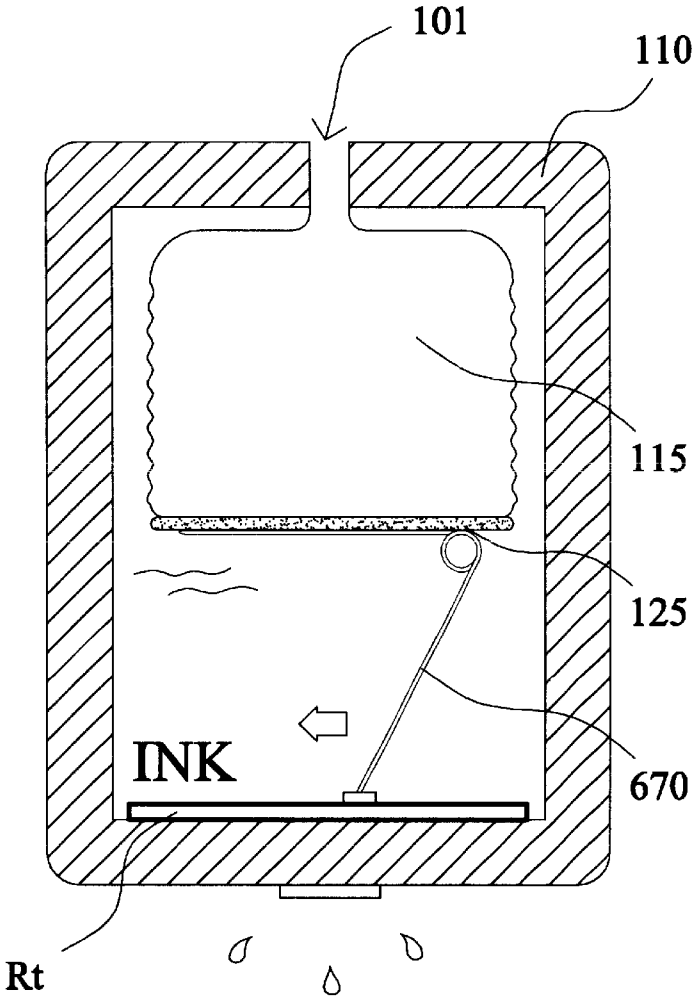
FIG. 6 shows a cross-sectional view of the adjustable device adjusted by using a torsion spring.

There are several alternatives for the structure by which the movable device adjusts the adjustable device. For instance, a torsion spring can be used as the movable device to adjust the electrical property of the adjustable device. Referring to FIG. 6, a cross-sectional view of the adjustable device adjusted by using a torsion spring is shown. The adjustable device Rt can be a slide-wire resistance. When the bag 115 moves downward, the torsion spring 670 deforms due to the compression by the bag 115. The contact point of the torsion spring 670 and the adjustable device Rt moves in the direction of the arrow sign, and the object of adjusting the adjustable device Rt is achieved.

The object of the invention is to measure the amount of ink remaining in an ink tank by using a sensing module to sense the variation in the volume of the bag within the ink tank and by using a detecting circuit coupled with a sensing module. In the aforementioned embodiments of the invention, the volume between the bag and the casing is filled with the ink, such that as the volume of ink decreases, the volume of the bag expands. A measurement of the ink amount is obtained according to the variation in the volume of the bag. For the case in which the bag is filled with the ink, the volume of the bag shrinks as the volume of ink decreases when ink is ejected. Thus a measurement of the ink amount can also be obtained according to the variation in the bag's volume, as illustrated in the following description.

Figure 7B:
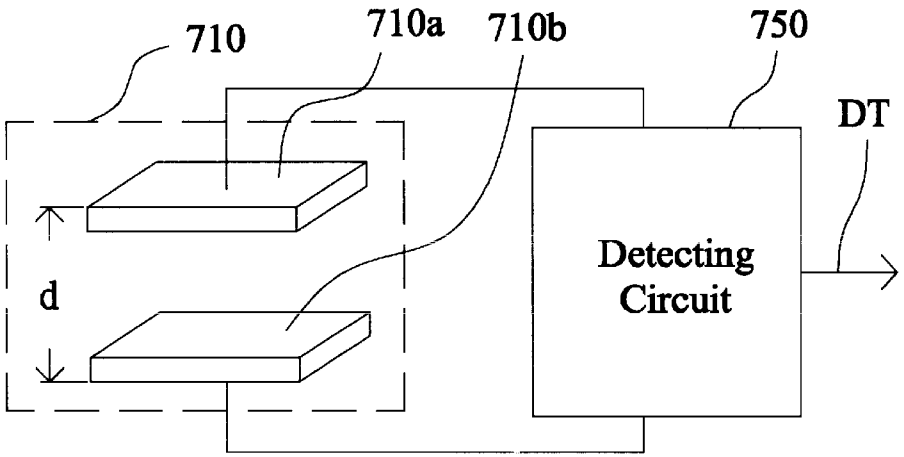
FIG. 7B shows the sensing module of FIG. 7A coupled with a detecting circuit.
Figure 7A:
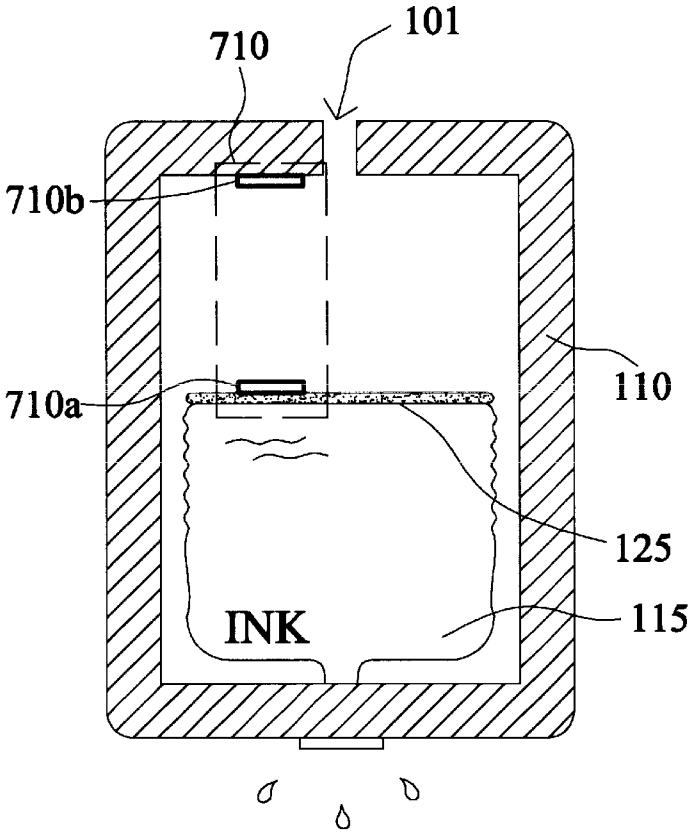
FIG. 7A shows a cross-sectional view of the apparatus for measuring the amount of ink remaining in the ink tank according to the fourth embodiment of the invention.

Referring to FIG. 7A, a cross-sectional view of an apparatus for measuring the amount of ink remaining in the ink tank according to the fourth embodiment of the invention is shown. The sensing module 710 includes a movable device 710*a* and a fixed device 710*b*. The movable device 710*a* is connected to the bag 115, for example, to the top of the bag 115. The fixed device 710*b* is connected to the casing 110, for example to the top of the casing 110. The movable device 710*a* moves with the bag 115 as the volume of the bag 115 changes. The relative position of the movable device 710*a* and the fixed device 710*b* varies with the volume of the bag 115, and thereby, a measurement of the ink amount can be obtained. Referring next to FIG. 7B, the sensing module 710 of FIG. 7A is coupled with the detecting circuit 750. When the bag 115 of FIG. 7A shrinks, the movable device 710*a* moves downward so that the distance d between the movable device 210*a* and the fixed device 210*b* increases. In practice, the movable device 710*a* and the fixed device 710*b* can be made of conductive plates. Thus, the movable device 710*a* and the fixed device 710*b* are viewed as two electrode plates of a capacitor and the ink as the dielectric between the two electrode plates. The capacitance decreases as the distance d increases. In other words, the capacitance decreases as the volume of ink decreases. The detecting circuit 750 generates the detection signal DT by detecting the variation in the capacitance. Thereby, a measurement of the ink amount can be accurately obtained according to the magnitude of the signal DT.

Furthermore, the sensing module 710 can be a transceiving module comprising a transmitting unit and a receiving unit. There are various kinds of transceiving modules having this function capability, such as an infrared transceiver, high-frequency transceiver, or optical transceiver. The types and dispositions of the transceiver are similar to those of FIGS. 3A and 3B, and can be referred to in the description of the first embodiment of the invention without reiteration.

The apparatus for measuring the ink amount remaining in an ink tank according to the invention utilizes the combination of a sensing module and a detecting circuit to obtain the measurement. The apparatus disclosed can accurately monitor the amount of ink in the ink tank, and therefore allows the user to maximize the usage of the ink tank.

While the invention has been described by way of examples and in terms of the preferred embodiments, it is to be understood that the invention is not limited to the embodiments disclosed herein. On the contrary, it is intended to cover various modifications and similar arrangements and procedures, and therefore the scope of the appended claims should be accorded the broadest interpretation so as to encompass all such modifications and similar arrangements and procedures.

What is claimed is:

1. An apparatus for measuring an amount of ink remaining in an ink tank, the ink tank having a casing and a bag, wherein the bag is disposed within the casing, the apparatus comprising:

a capacitor, including:

a fixed electrode plate, connected to the casing, and a movable electrode plate, connected to the bag and moving with the bag as the volume of the bag changes, such that variations In capacitance of the capacitor are made according to a relative position of the movable electrode plate and the fixed electrode plate; and a detecting circuit, coupled with the capacitor and responsive to an from the capacitor Indicative of the variations in capacitance, for generating and outputting a detection signal, a magnitude of with is indicative of the amount of Ink remaining in the tank as the amount changes.

2. The apparatus according to claim 1, wherein the detection signal is generated for Informing the measurement of the amount of ink when the movable device is coupled with the fixed device.

3. The apparatus according to claim 1, wherein the ink fills the volume between the casing and the bag.

4. The apparatus according to claim 3, wherein the bag communicated with atmosphere is used to modulate the pressure within the casing.

5. The apparatus according to claim 1, wherein the ink fills the bag.

6. The apparatus according to claim 5, wherein the casing communicated with atmosphere is used to modulate the pressure within the bag.

7. An Ink tank having an apparatus for measuring an amount of ink remaining in the ink tank, the ink tank comprising:

a casing;

a bag, wherein the bag Is disposed within the casing;

a transceiving module for transmitting and receiving a transceiver signal, including a fixed device, connected to the casing, and a movable device, connected to the bag and moving with the bag as the volume of the bag changes, such that the transceiver signal varies in magnitude according to a relative position of the movable device and the fixed device; and a detecting circuit, coupled with the transceiving module and responsive to the transceiver signal, for determining, and outputting a detection signal indicative of the amount of ink remaining in the tank according to variations in magnitude of the transceiver signal.

8. The apparatus according to claim 7, wherein the transceiving module is a high-frequency transceiver.

9. The apparatus according to claim 7, wherein the transceiving module is an infrared transceiver.

10. The apparatus according to claim 7, wherein the transceiving module is an optical transceiver.

11. The apparatus according to claim 10, wherein the optical transceiver is a transmissive transceiver.

12. The apparatus according to claim 10, wherein the optical transceiver is a reflective transceiver.

13. The apparatus according to claim 7, wherein the detecting circuit is coupled with the transceiving module and responsive to the transceiver signal, so that any changes in the amount of ink remaining in the tank, as reflected by the variations in the magnitude of the transceiver signal, are indicated by changes in the detection signal.

14. The apparatus according to claim 7, wherein the ink fills the bag.

15. The apparatus according to claim 14, wherein the casing communicated with atmosphere is used to modulate the pressure within the bag.

16. The apparatus according to claim 7, wherein the ink fills the volume the casing and the bag.

17. The apparatus according to claim 16, wherein the bag communicated with atmosphere is used to modulate the pressure within the casing.

18. An apparatus for measuring an amount of ink remaining in an ink tank, the ink tank including a casing and a bag, wherein the bag is disposed within the casing, the apparatus comprising:

a plurality of fixed devices, connected to the casing and spaced at intervals;

a movable device, connected to the bag and sequentially coupled with the fixed devices as the volume of the bag changes; and a detecting circuit, coupled with the movable device and the fixed devices, and responsive to a coupling relation of the movable device and the fixed devices, for generating a detection signal indicative of a changing amount of ink in the tank.

19. The apparatus according to claim 18, wherein the detection signal is a voltage signal.

20. The apparatus according to claim 18, wherein the detection signal is a current signal.

21. The apparatus according to claim 18, wherein the fixed devices are normally open switches.

22. The apparatus according to claim 18, herein the fixed devices are normally closed switches.

23. The apparatus according to claim 18, wherein the movable device is a normally open switch.

24. The apparatus according to claim 18, wherein the movable device is a normally closed switch.

25. An apparatus for measuring an amount of ink remaining in an ink tank, the ink tank including a casing and a bag, wherein the bag is disposed within the casing, the apparatus comprising:

an adjustable device, connected to the casing;

a movable device, one end of which is connected to the bag and the other end of which is coupled with the adjustable device, for adjusting an interaction between the movable device and the adjustable device as the volume of the bag changes, such that an electrical property of the adjustable device varies according to the interaction between the movable device and the adjustable device; and a detecting circuit, coupled with the adjustable device, for measuring the varying electrical property and generating a detection signal having a magnitude indicative of the amount of ink remaining in the tank.

26. The apparatus according to claim 25, wherein the adjustable device is a slide-wire resistance.

27. The apparatus according to claim 25, wherein the movable device is a torsion spring.

28. The apparatus according to claim 25, wherein the detection signal is a voltage signal.

29. The apparatus according to claim 25, wherein the electrical property is a resistance value of the adjustable device.

30. The apparatus according to claim 25, wherein the detecting circuit is coupled with the adjustable device and responsive to the varying electrical property, so that any changes in the amount of ink remaining in the tank, as reflected by the variations in the electrical property, are indicated by changes in the detection signal.

* * * * *